US010224144B2

(12) United States Patent
Watanabe et al.

(10) Patent No.: US 10,224,144 B2
(45) Date of Patent: Mar. 5, 2019

(54) SURFACE-MOUNT INDUCTOR

(71) Applicant: TOKO, INC., Tsurugashima-shi, Saitama-ken (JP)

(72) Inventors: Ryota Watanabe, Tsurugashima (JP); Takeo Ohaga, Tsurugashima (JP); Hiroyasu Mori, Tsurugashima (JP); Yasutaka Mizukoshi, Tsurugashima (JP); Takumi Arai, Tsurugashima (JP); Masaaki Totsuka, Tsurugashima (JP); Kunio Sasamori, Tsurugashima (JP)

(73) Assignee: Murata Manufacturing Co., Ltd., Nagaokakyo-shi, Kyoto (JP)

( * ) Notice: Subject to any disclaimer, the term of this patent is extended or adjusted under 35 U.S.C. 154(b) by 6 days.

(21) Appl. No.: 14/972,965

(22) Filed: Dec. 17, 2015

(65) Prior Publication Data

US 2016/0181014 A1 Jun. 23, 2016

(30) Foreign Application Priority Data

Dec. 20, 2014 (JP) ..... 2014-258141

(51) Int. Cl.
*H01F 27/29* (2006.01)
*H01F 27/28* (2006.01)
(Continued)

(52) U.S. Cl.
CPC ..... *H01F 27/292* (2013.01); *H01F 27/255* (2013.01); *H01F 27/2828* (2013.01); *H01F 27/306* (2013.01)

(58) Field of Classification Search
CPC ..... H01F 27/2828; H01F 27/292
See application file for complete search history.

(56) References Cited

U.S. PATENT DOCUMENTS 5,457,872 A * 10/1995 Sakata ..... H01F 27/292 29/605
2006/0186975 A1* 8/2006 Wang ..... H01F 3/08 335/83
(Continued)

FOREIGN PATENT DOCUMENTS

DE 102010062783 A1 * 6/2011 ..... H01F 5/04
JP 2005-310812 A 11/2005
(Continued)

OTHER PUBLICATIONS

JP2005310812A, Nov. 2005, Machine Translation.*
(Continued)

*Primary Examiner* — Elvin G Enad
*Assistant Examiner* — Malcolm Barnes
(74) *Attorney, Agent, or Firm* — Renner, Kenner, Greive, Bobak, Taylor & Weber

(57) ABSTRACT

A surface-mount inductor including: a coil formed by winding insulated wire and bringing out lead ends therefrom; and a plurality of premolded bodies for accommodating the coil inside, thereby thermopressing to form, wherein a pair of metal terminals is embedded laterally on the outer surface of the surface-mount inductor, and the lead ends of the coil are brought out from the bottom surface of the surface-mount inductor and laterally laid on the outer surface of the metal terminals, as well as a method for manufacturing the same.

2 Claims, 7 Drawing Sheets

(51) Int. Cl.
*H01F 27/255* (2006.01)
*H01F 27/30* (2006.01)

(56) References Cited

U.S. PATENT DOCUMENTS

| | | | | |
|---|---|---|---|---|
| 2008/0310051 | A1* | 12/2008 | Yan | H01F 17/045 360/123.01 |
| 2012/0188045 | A1* | 7/2012 | Yamada | H01F 27/292 336/192 |
| 2014/0068926 | A1 | 3/2014 | Saito et al. | |
| 2014/0210586 | A1* | 7/2014 | Atsumi | H01F 27/292 336/192 |
| 2014/0218157 | A1* | 8/2014 | Liu | H01F 27/29 336/192 |
| 2016/0086725 | A1* | 3/2016 | Igarashi | H01F 27/29 336/83 |
| 2016/0351323 | A1* | 12/2016 | Wakamori | H01F 17/041 |

FOREIGN PATENT DOCUMENTS

| | | | | |
|---|---|---|---|---|
| JP | 2005310812 | * | 11/2005 | H01F 17/04 |
| JP | 2005310812 A | * | 11/2005 | H01F 17/04 |
| JP | 2010-87240 A | | 4/2010 | |
| JP | 2010-245473 A | | 10/2010 | |
| JP | 2011-54713 A | | 3/2011 | |

OTHER PUBLICATIONS

JP2005310812, Nov. 2005, Machine Translation.*
Japanese Decision of Rejection with English Translation (Application No. JP 2014-258141) (4 pages—dated Jan. 10, 2017).

* cited by examiner

SURFACE-MOUNT INDUCTOR

CROSS-REFERENCE TO RELATED APPLICATION

This application is based upon and claims the benefit of priority from the prior Japanese Patent Application No. 2014-258141, filed on Dec. 20, 2014, the entire contents of which are incorporated herein by reference.

BACKGROUND OF THE INVENTION

1. Field of the Invention

The present invention relates to a surface-mount inductor and a method for manufacturing the same.

2. Description of the Related Art

As shown in JP2010-245473 (patent document 1), an inductor having a coil embedded in magnetic resin, which is a mixture of magnetic powder and resin, has been widely used. A molded coil which is embedded in magnetic resin is configured as a surface-mount inductor which is built by forming electrodes for mounting on a printed wiring board. The electrodes being made by painting an electric conductive paste which is made by dispersing metal particles such as Ag in thermosetting resin such as epoxy resin, or adhering metal terminals to the molded coil.

SUMMARY OF THE INVENTION

Problem to be solved by the Invention

As the electric conductive paste is expensive, it is costly to apply it over a large area. Thus, metal plates are widely used instead as external terminals of large-size surface-mount inductors. Methods for manufacturing such surface-mount inductors are disclosed in JP2010-087240 (patent document 2) and JP2011-054713 (patent document 3), for example.

The patent document 2 discloses a method for manufacturing a surface-mount inductor in which a molded coil is formed by embedding a coil in magnetic resin with exposed lead ends brought out therefrom, preliminarily folding metal terminals in a predetermined shape, attaching the metal terminals to the molded coil, and electrically connecting the lead ends and the metal terminals by soldering or welding.

The patent document 3 discloses another method for manufacturing a surface-mount inductor in which lead ends and metal terminals are connected by soldering or welding, the lead ends and a part of a metal plate including the connecting portion thereof are embedded in magnetic resin to form a molded coil, the metal plate exposed from the molded coil being folded along the outermost turn of the molded coil to form metal terminals.

The method for manufacturing the surface-mount inductor in the patent document 2 has some issues. One of them is the large size of the surface-mount inductor due to the metal terminals being mounted after the completion of the coil. The size of the inductor varies with the thickness of the metal terminals. Another issue is the terminals falling off due to the adherence of the adhesive being deteriorated when soldering the metal terminals onto the molded coil.

Further, the method for manufacturing the surface-mount inductor in the patent document 3 has a problem in that the portion connecting the metal terminals and the lead ends is embedded in the molded coil so that it is not possible to visually confirm the connecting state.

Means for Solving the Problem

A surface-mount inductor according to the present invention is characterized by a surface-mount inductor including: a coil formed by winding insulated wire and bringing out lead ends therefrom; and a premolded body formed by thermopressing into a form a mixture of magnetic powder and thermosetting resin to accommodate the coil whose lead ends are brought out therefrom; comprising a pair of metal terminals made of deformable plates, and arranged on the outer exposed surface of the premolded body; and a coil the lead ends of which are embedded at the outer exposed surface.

A method for manufacturing a surface-mount inductor according to the present invention is characterized by the steps of:

mixing magnetic powder and thermosetting resin so as to produce a combination-type premolded body of predetermined shape; and preparing a coil formed by winding an insulated wire, accommodating the coil in the combination-type premolded body with the lead ends of the coil brought out therefrom, arranging the metal terminals on the outer surface of the premolded body, arranging the lead ends on the outer surface of the metal terminals, and thermopressing the premolded body into form.

Effect of the Invention

According to the surface-mount inductor of the present invention, a surface-mount inductor may be manufactured without using any adhesive, thus metal terminals do not fall off since the metal terminals are partially embedded in the resin. And, the portion connecting the metal terminals and the lead ends is exposed on the surface of the surface-mount inductor so that the connecting state may be visually confirmed.

DETAILED DESCRIPTION OF THE INVENTION

The surface-mount inductor according to the present invention is described below, referring to FIGS. 1-6.

Figure 1:
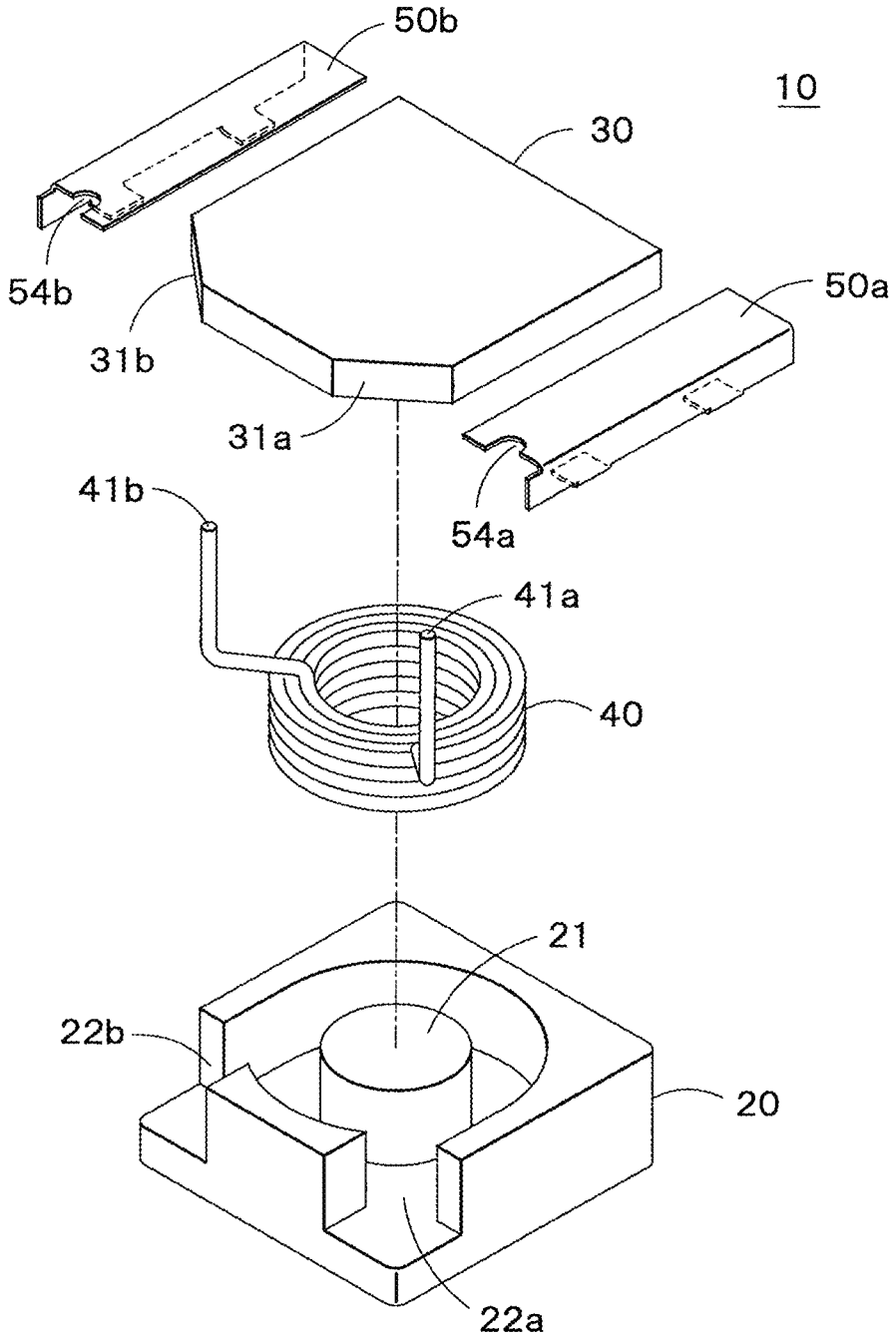
FIG. 1 is a broken perspective view showing the structure of a surface-mount inductor according to the present invention.
Figure 2:
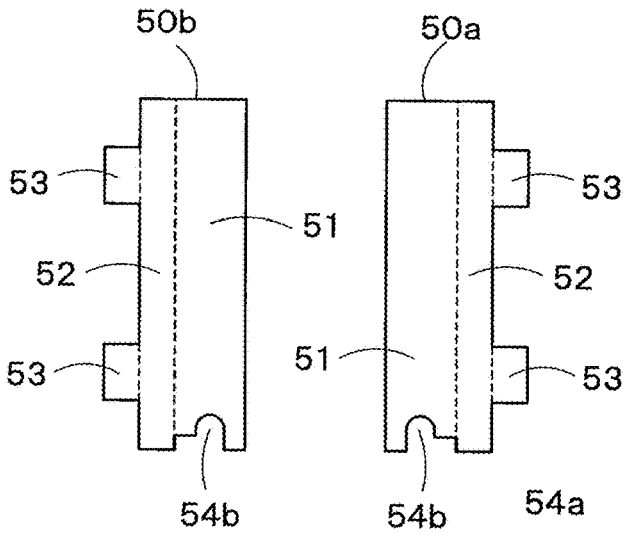
FIG. 2 is a development view of the metal terminals in the structure of FIG. 1.

FIG. 1 is an exploded perspective view from bottom up describing the structure of the surface-mount inductor of the present invention, and FIG. 2 is a development view of the metal terminals in the structure of FIG. 1.

The surface-mount inductor 10 includes: premolded bodies 20, 30 formed by pressure forming magnetic resin, which is a mixture of magnetic powder and thermosetting resin such as epoxy resin; coil 40 formed by winding an insulated wire; and a pair of metal terminals 50*a*, 50*b* formed by punching a thin metal plate and by folding in a predetermined shape which are connected with both of the lead ends 41*a*, 41*b*, respectively.

The premolded body 20 has a rectangular parallelepipedic profile, a cylindrical pot-like space inside, and a protruded portion 21 provided at the center of the bottom surface inside the space. The premolded body 20 has an E-shaped longitudinal section, and the outer wall thereof is partially cut out at the corners to make open portions 22*a*, 22*b*.

The premolded body 30 fitted with the premolded body 20 is substantially rectangular in plan view and the corners 31*a*, 31*b* are chamfered.

The coil 40 is wound to be cylindrical in shape, and the lead ends are brought out from the outermost turn in radial directions outwardly and folded about 90° in the direction of the center axis of the coil 40.

As shown in FIG. 2, the metal terminals 50*a* and 50*b* consisting of a metal plate having an L-shaped cross section, includes: a bottom surface 51; and a side surface 52 formed by folding at 90° along the broken line close to the center. The side surface 52 has tongue-like embedding portions 53 formed by folding at 90° in the same direction as that of the bottom surface 51 at the position indicated by the other broken line closer to the end, and a cutout 54*a* at the lower part in FIG. 2. The metal terminals 50*a* and 50*b* are symmetrical, with the metal terminal 50*b* having a cutout 54*b* similarly to the metal terminal 50*a*.

The method for manufacturing the surface-mount inductor according to the present invention is described referring sequentially to FIGS. 3A through 3F.

Figure 3A:
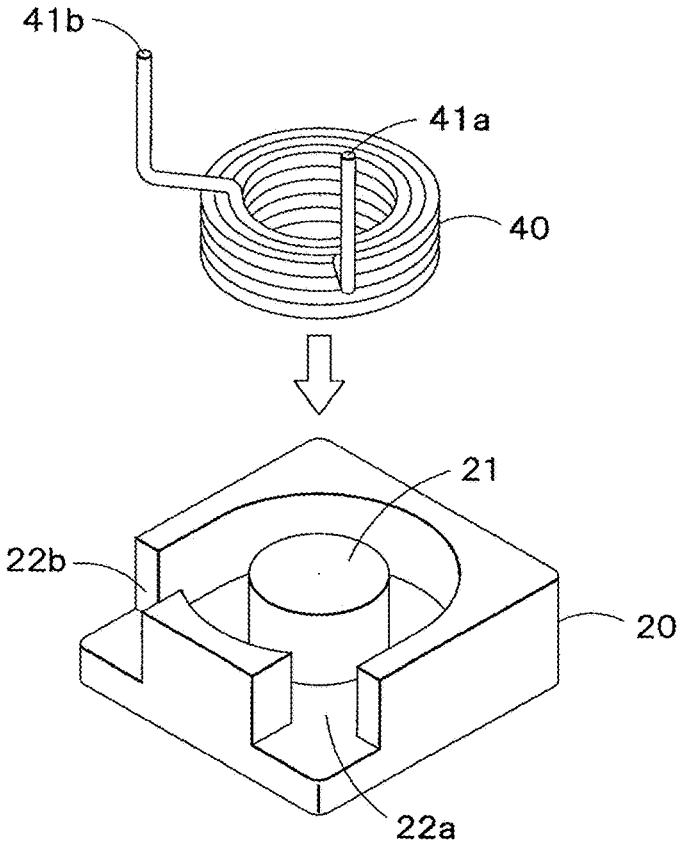
FIG. 3A through FIG. 3F show steps in the manufacturing process of the surface-mount inductor according to the present invention.

FIG. 3A: The coil 40 is accommodated in the premolded body 20 in a manner that the lead ends 41*a*, 41*b* are placed at the open portions 22*a*, 22*b*.

Figure 3B:
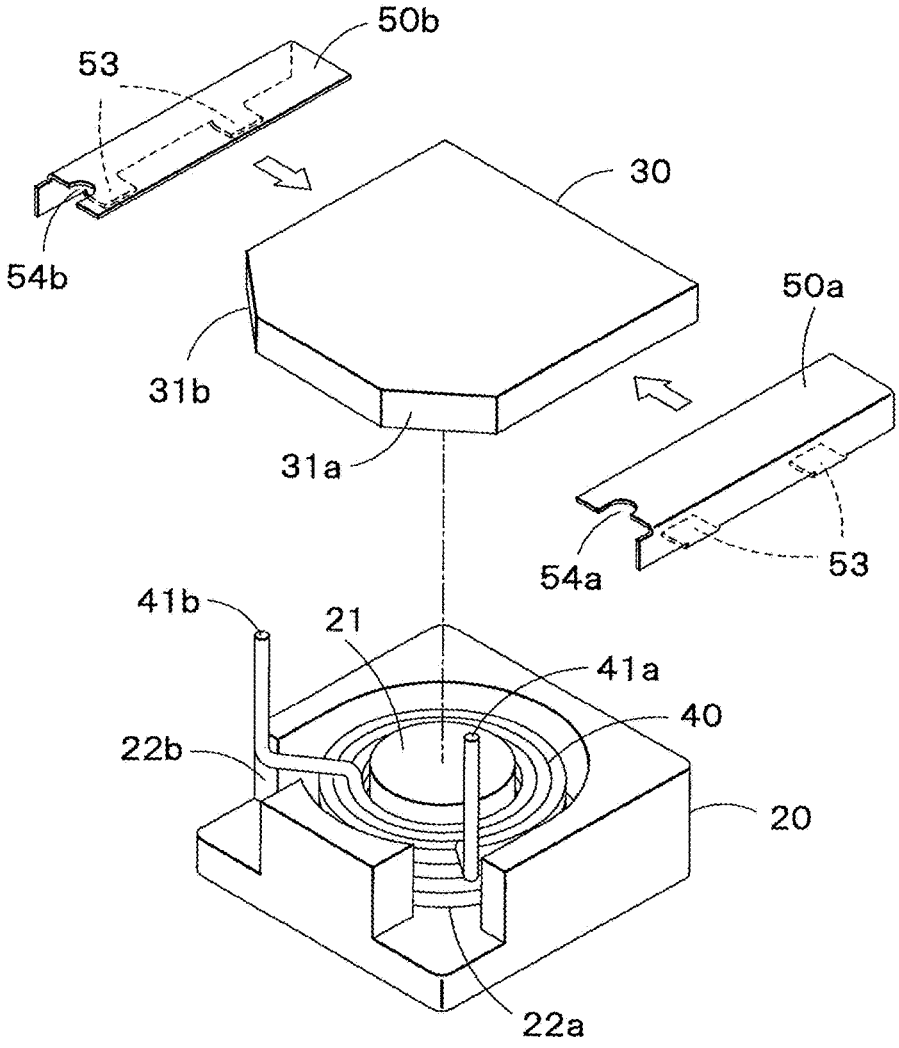

FIG. 3B: The metal terminals 50*a*, 50*b* are arranged at both sides of the premolded body 30 in a manner that the corner portion 31*a* is in line with the cutout 54*a* and the corner portion 31*b* is in line with the cutout 54*b*, respectively.

Figure 3C:
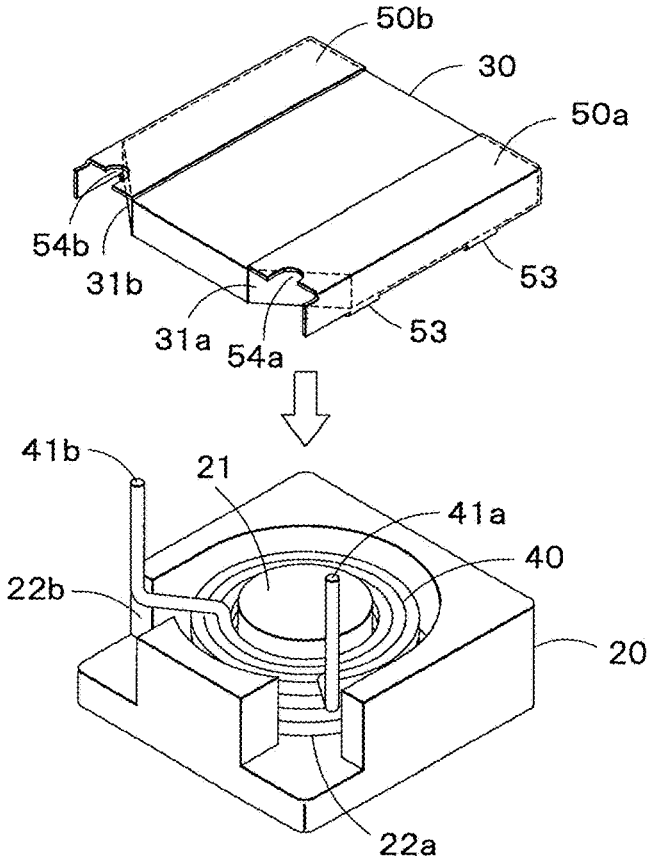

FIG. 3C: The premolded body 30 is overlapped with the premolded body 20 in a manner that the lead ends 41*a*, 41*b* are brought out from the cutouts 54*a*, 54*b* of the metal terminals 50*a*, 50*b*.

Figure 3D:
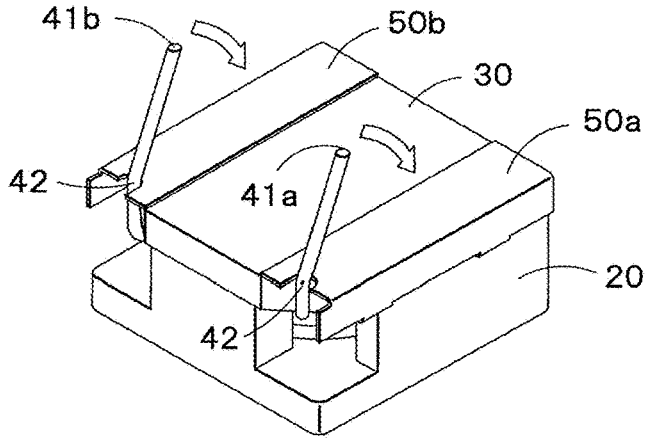
Figure 3E:
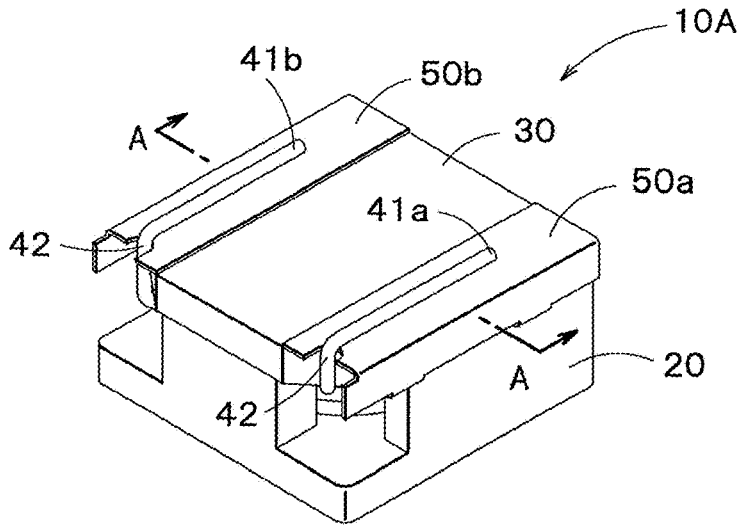

FIGS. 3D, 3E: The lead ends 41*a*, 41*b* brought out from the premolded body 30 are folded at the base portions 42, 42 which are exposed from the premolded body 30, and arranged along the upper surface of the metal terminals 50*a*, 50*b*. The surface-mount inductor in FIG. 3E is referred to as "pre-formed surface-mount inductor 10A" hereinbelow.

Figure 3F:
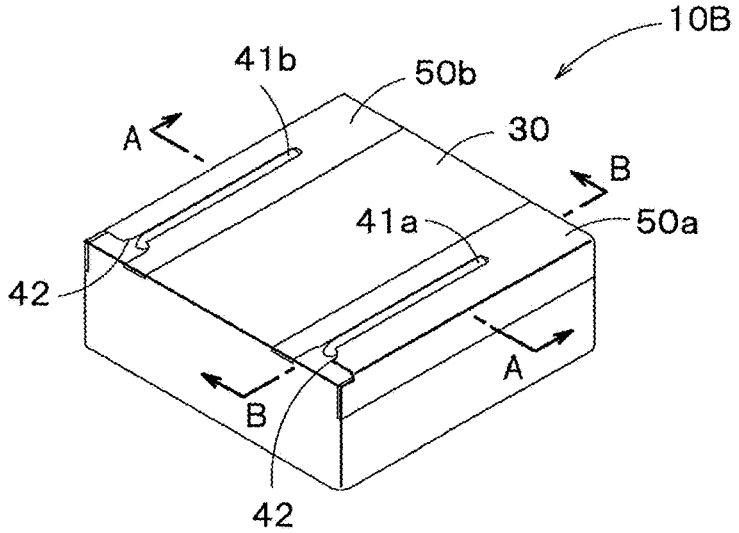

FIG. 3F: The pre-formed surface-mount inductor 10A is thermopressed ("forming" hereinbelow) in the mold to form "formed surface-mount inductor 10B (before connecting to terminals)".

Processing the formed surface-mount inductor 10B by dip soldering, the insulation layer of the lead ends 41*a*, 41*b* are removed and at the same time the lead ends 41*a*, 41*b* and the metal terminals 50*a*, 50*b* are electrically connected to form the surface-mount inductor 10 as a formed article. Here, dip soldering may be replaced by thermocompression bonding.

Figure 4A:
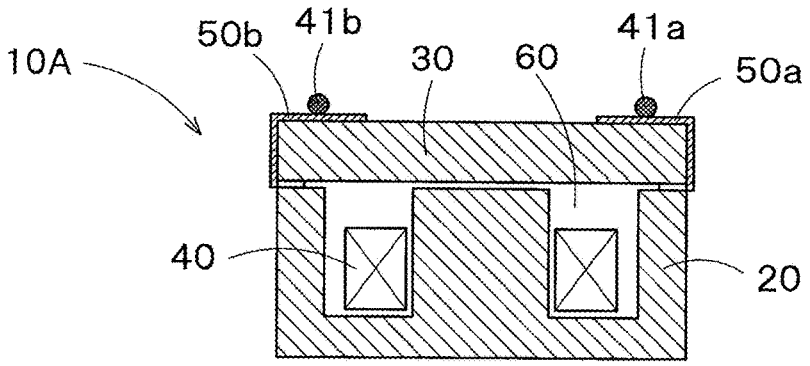
FIG. 4A is a cross sectional view of the surface-mount inductor before the forming process according to the present invention.
Figure 4B:
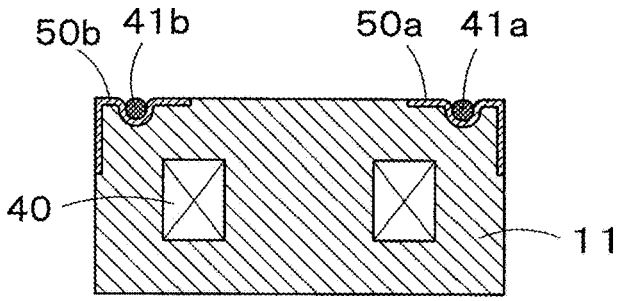
FIG. 4B is a cross sectional view of the surface-mount inductor after the forming process according to the present invention.

FIG. 4A is a longitudinal sectional view of the pre-formed surface-mount inductor 10A (along section A-A in FIG. 3E), and FIG. 4B is a longitudinal sectional view of the formed surface-mount inductor 10B (along section A-A in FIG. 3F).

As shown in FIG. 4A, the pre-formed surface-mount inductor 10A has the lead ends 41*a*, 41*b* mounted on the metal terminals 50*a*, 50*b*, and there are vacant spaces 60 between the coil 40 and the premolded bodies 20, 30 and vacant spaces of the open portions 22*a*, 22*b* (FIG. 1, FIG. 3A-3E) inside the premolded bodies 20, 30.

As shown in FIG. 4B, the surface-mount inductor 10B is so configured that the premolded bodies 20, 30 are pressed as to inversely deform so as to fill the vacant spaces, and in turn the embedding portions 53 (FIG. 2) are buried in the mold coil 11. The metal terminals 50*a*, 50*b* are embedded into the mold coil 11 to a depth corresponding to their thickness, and the lead ends 41*a*, 41*b* are embedded into the metal terminals 50*a*, 50*b* to a depth equal to their diameter. The thermosetting resin is then completely hardened by heating which result in the surface-mount inductor 10 having a flat surface.

Figure 5:
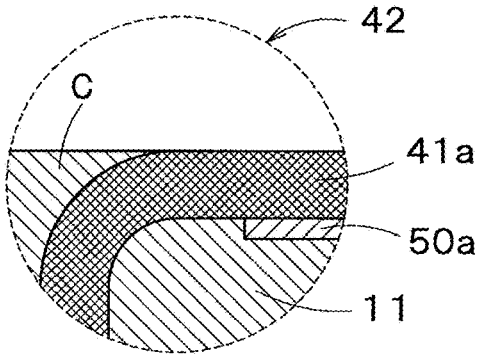
FIG. 5 is an enlarged cross sectional view of the surface-mount inductor according to the present invention.

FIG. 5 is an enlarged-sectional view showing the longitudinal section (section B-B in FIG. 3F) around the base portion 42 of the coil 40.

As shown in FIG. 5, "springback" (effect) in the coil 40 is moderated because the outer periphery ("C" in FIG. 5) of the lead ends 41*a* is filled with resin around the base portion 42.

Since the metal terminals 50*a*, 50*b* are preferably thin so that the lead ends 41*a*, 41*b* are easily embedded therein, the material of the metal terminals 50*a*, 50*b* is preferably soft so as to easily deform when the lead ends 41*a*, 41*b* embed therein, tough pitch copper being preferable to phosphor bronze thus the use of relatively soft normalized hardness of less than ½ H, for example, thin metal terminals 50*a*, 50*b* is ideal.

Figure 6:
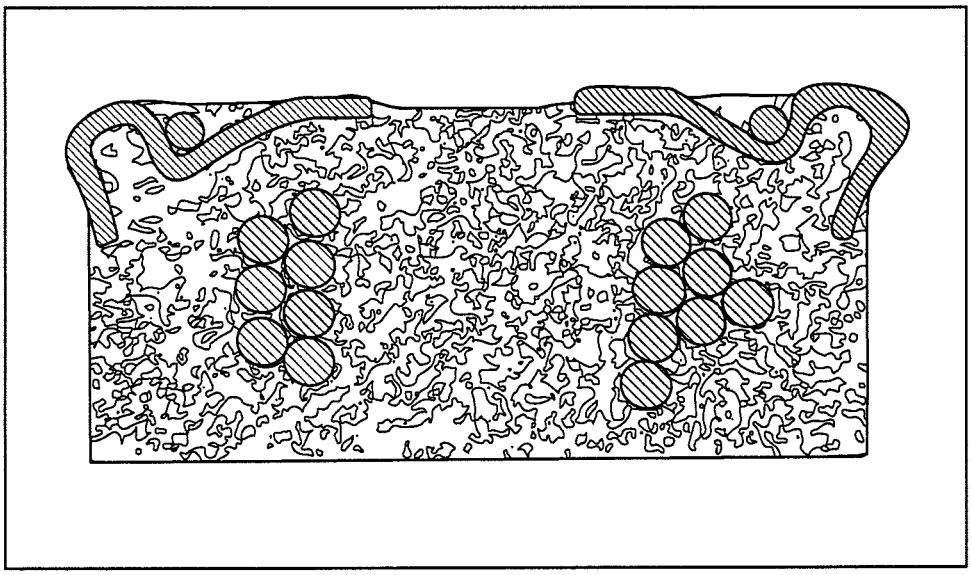
FIG. 6 is a depiction of a cross sectional view of the surface-mount inductor according to the present invention.

FIG. 6 is a depiction of the cross sectional view of the surface-mount inductor manufactured by the method described above. The surface-mount inductor is configured to have a 6 mm width×6 mm length×3 mm height, with the diameter of the wire being 0.23 mm, the thickness of the metal terminals made of phosphor bronze being 0.08 mm, and the forming pressure being 10 kg/cm$^2$.

As shown in FIG. 6, the lead ends sink into the metal terminals, and the metal terminals are embedded into the surface-mount inductor in their thickness direction.

The surface-mount inductor described above enables preventing the falling off of the metal terminals because the metal terminals are partially embedded in the mold coil, and the state of the connection may be visually recognized.

Further, the metal terminals do not increase the size of the surface-mount inductor because the lead ends sink in the metal terminals and in turn the metal terminals sink in the mold coil.

Furthermore, since the base portions of the lead ends are also embedded in resin, the position shift caused by the spring back before electrically connecting the lead ends to the metal terminals, and the loss of connection between the lead ends and the metal terminals when melting solder to solder on the mounting board, is minimized.

In the process of forming the premolded body, resin from the magnetic resin permeates the premolded body and covers a part of the bottom surface thus obstructing the mounting of the surface-mount inductor. In such a case, the premolded body should be processed by means of barrel polishing and the like to remove the permeating resin.

In addition, the portion embedding the metal terminals may be selected to have, for example, a wide-top shape or a hollow structure in order to provide a surface-mount inductor with metal terminals which do not easily fall off therefrom.

EXPLANATION OF CODES

10 surface-mount inductor
10A pre-formed surface-mount inductor
10B formed surface-mount inductor
11 mold coil
20, 30 premolded body
21 protruded portion
22*a*, 22*b* open portion
31*a*, 31*b* chamfered portion
40 coil
41*a*, 41*b* lead end
42 base portion
50*a*, 50*b* metal terminal
51 bottom surface
52 side surface
53 embedded portion
54 cutout

What is claimed is:

1. A surface-mount inductor including: a coil formed by winding insulated wire and bringing out lead ends therefrom; and a premolded body formed of a mixture of magnetic powder and thermosetting resin to accommodate the coil whose lead ends are brought out therefrom, whereby processing the premolded body by thermopressing to form, the surface-mount inductor comprising a pair of metal terminals each of which comprises a bottom surface portion with a cutout from which one of the lead ends is brought out, a side surface portion folded from the bottom surface portion, and an embedding portion folded from the side surface portion in parallel to the bottom surface portion, the embedding portion being embedded into an inside of the surface-mount inductor, and the bottom surface portion and the side surface portion being arranged on an outer exposed surface of the surface-mount inductor and being embedded thereon in their thickness direction, wherein each of the lead ends is brought out from the cutout of the bottom surface portion of one of the metal terminals onto the bottom surface portion of one of the metal terminals and arranged on and extending along the bottom surface portion of the metal terminal, a base portion brought out from the cutout of the metal terminal being embedded into the bottom surface of the surface-mount inductor together with the cutout; and each of the lead ends arranged on the outer surface of the metal terminal, together with the metal terminal, are embedded on the bottom of the outer exposed surface of the surface-mount inductor in its diameter direction, wherein the lead ends of the winding and the metal terminals are connected with solder, respectively, and the metal terminals are formed on the bottom surface of the outer exposed surface of the surface-mount inductor, and the metal terminals comprise a winding lead ends base region, a winding lead ends embedded region and a terminal region.

2. A surface-mount inductor including: a coil formed by winding insulated wire and bringing out lead ends therefrom; and a premolded body formed of a mixture of magnetic powder and thermosetting resin to accommodate the coil whose lead ends are brought out therefrom, whereby processing the premolded body by thermopressing to form, wherein each of a pair of metal terminals comprises a bottom surface portion with a cutout from which one of the lead ends is brought out, a side surface portion folded from the bottom surface portion, and an embedding portion folded from the side surface portion and embedded into an inside of the surface-mount inductor, and the bottom surface portion being arranged to be embedded on a bottom surface of an outer exposed surface of the surface-mount inductor in its thickness direction, wherein each of the lead ends is brought out from the cutout of one of the metal terminals onto the bottom surface portion of one of the metal terminals, and arranged on and extending along the bottom surface portion of the metal terminal, a base portion brought out from the cutout of the metal terminal being embedded into the bottom surface of the surface-mount inductor together with the cutout; and each of the lead ends arranged on the outer surface of the metal terminal, together with the metal terminal, are embedded on the bottom surface of the outer exposed surface of the surface-mount inductor in its diameter direction, wherein the lead ends of the winding and the metal terminals are connected with solder, respectively, and the metal terminals are formed on the bottom surface of the outer exposed surface of the surface-mount inductor, and the metal terminals comprise a winding lead ends base region, a winding lead ends embedded region and a terminal region.

* * * * *